US005896918A

United States Patent [19]

Witte

[11] Patent Number: 5,896,918

[45] Date of Patent: Apr. 27, 1999

[54] HEAT EXCHANGER TUBE

[75] Inventor: Raimund Witte, Dortmund, Germany

[73] Assignee: GEA Energietechnik GmbH, Bochum, Germany

[21] Appl. No.: 09/008,443

[22] Filed: Jan. 16, 1998

[30] Foreign Application Priority Data

Jan. 18, 1997 [DE] Germany ..... 197 01 598

[51] Int. Cl.[6] ..... F28B 1/06

[52] U.S. Cl. ..... 165/111; 165/146; 165/147; 165/114

[58] Field of Search ..... 165/111, 146, 165/147, 110, 114

[56] References Cited

U.S. PATENT DOCUMENTS

| | | | |
|---|---|---|---|
| 2,205,292 | 6/1940 | Howard | 165/114 |
| 3,451,388 | 6/1969 | Eck | 165/147 X |
| 4,168,742 | 9/1979 | Kluppel et al. | 165/114 |
| 5,099,913 | 3/1992 | Kadle | 165/147 |
| 5,137,082 | 8/1992 | Shimoya et al. | 165/110 |

FOREIGN PATENT DOCUMENTS

| | | | |
|---|---|---|---|
| 528712 | 11/1972 | Switzerland | 165/111 |
| 646444 | 11/1950 | United Kingdom | 165/146 |

*Primary Examiner*—Leonard R. Leo
*Attorney, Agent, or Firm*—Friedrich Kueffner

[57] ABSTRACT

A heat exchanger tube for condensing steam with the use of cooling air includes an upper steam supply and a lower condensate discharge. The heat exchanger tube has an elongated cross-section in the flow direction of the transversely flowing cooling air. The interior of the tube is divided by a separating wall extending transversely of the flow direction of the cooling air into a condenser stretch whose cross-section becomes smaller in the flow direction of the steam and a dephlegmator stretch whose cross-section becomes smaller in the flow direction of the steam, wherein the condenser stretch is at the lower end thereof connected to the dephlegmator stretch for conducting steam from the condenser stretch to the dephlegmator stretch, and wherein a gas/steam mixture exhauster is mounted at the upper end of the dephlagmator stretch.

7 Claims, 3 Drawing Sheets

HEAT EXCHANGER TUBE

BACKGROUND OF THE INVENTION

1. Field of the Invention

The present invention relates to a heat exchanger tube for condensing steam by means of cooling air with an upper steam supply and a lower condensate discharge.

2. Description of the Related Art

Heat exchanger tubes of this type are usually combined in groups or rows and are coupled to other heat exchanger tubes operated as dephlegmators to form air-cooled condensers. In this connection, the heat exchanger tubes operated as dephlegmators particularly have the purpose of preventing the danger of freezing.

In accordance with the prior art, the heat exchanger tubes operated as dephlegmators, i.e., wherein the condensate flows in a counter-current flow to the steam, are arranged separately from the heat exchanger tubes operated in a co-current flow, i.e., wherein the condensate flows in the same direction as the steam, and the excess steam from the heat exchanger tubes operated as condensers is conducted through collection chambers and pipelines from below into the heat exchanger tubes operated as dephlegmators, or alternatively, the excess steam is allowed to flow through a collection chamber from below into the heat exchanger tubes operated in a counter-current flow. All heat exchanger tubes are arranged in a condenser. This condenser can be combined with additional condensers, particularly in a roof-shaped configuration.

Although the conventional principle has basically proved to be successful, it must be pointed out from practical experience that, in the past, it was always necessary to make compromises particularly with respect to the condenser/dephlegmator ratio. These compromises were due to different weather conditions prevailing over the course of a year, the maximum quantity of steam to be processed, and also the configuration of the heat exchanger tube groups in relation to the different ventilators provided for these groups.

In addition, in accordance with the prior art, pipelines are required for conducting excess steam from the heat exchanger tubes operated as condensers into the separately arranged heat exchanger tubes operated as dephlegmators. Moreover, frequently the phenomenon called "swallowing" of condensate in the heat exchanger tubes operated as dephlegmators must be observed. This phenomenon occurs when the steam velocities when entering the heat exchanger tubes operated as dephlegmators are still so high that the condensate flowing downwardly in a counter-current flow in these heat exchanger tubes is held up in the manner of an umbrella or buffer or this condensate column may even be pressed further upwardly. This "swallowing" phenomenon significantly reduces the efficiency of a condenser.

SUMMARY OF THE INVENTION

Therefore, it is the primary object of the present invention, starting from the above-described prior art, to propose a heat exchanger tube which is of simple construction and configuration and which allows a specific adjustment of the condenser/dephlegmator ratio.

In accordance with the present invention, the heat exchanger tube has an elongated cross-section in flow direction of the transversely flowing cooling air. The interior of the tube is divided by a separating wall extending transversely of the flow direction of the cooling air into a condenser stretch or portion whose cross-section becomes smaller in the flow direction of the steam and a dephlegmator stretch or portion whose cross-section becomes smaller in the flow direction of the steam, wherein the condenser stretch is at the lower end thereof connected to the dephlegmator stretch for conducting steam from the condenser stretch to the dephlegmator stretch, and wherein a gas/steam mixture exhauster is mounted at the upper end of the dephlagmator stretch.

The basic concept of the present invention resides in the fact that the interior of a heat exchanger tube can be operated simultaneously as a condenser and as a dephlegmator. For this purpose, a separating wall is mounted in the interior of the tube so as to extend in the flow direction of the steam, wherein the separating wall extends transversely of the flow direction of the cooling air. The separating wall is mounted in such a way that on one side of the separating wall is formed a condenser stretch whose cross-section becomes smaller in the flow direction of the steam and on the other side of the separating wall is formed a dephlegmator stretch whose cross-section also becomes smaller in the flow direction of the steam. The condenser stretch and the dephlegmator stretch are in communication with each other at the lower end of the heat exchanger tube.

The steam to be condensed enters the condenser stretch from above, flows downwardly in the condenser stretch and is partially condensed by the cooling air in the condenser stretch. The condensate, the residual steam and any gases which cannot be condensed leave the condenser stretch at the lower end thereof. The residual steam and the gases which cannot be condensed flow into the dephlegmator stretch and flow in the dephlegmator stretch upwardly in the direction toward a gas/steam mixture exhauster. As the residual steam travels upwardly, it is almost completely condensed. At the upper end of the dephlegmator stretch, a mixture of non-condensable gases and steam collects, wherein the mixture is undercooled by the cooling air as compared to the condensation temperature and is removed in this manner by the gas/steam mixture exhauster, for example, an evacuating device. The condensate from the condenser stretch and the dephlegmator stretch flows as a result of gravity through a pipeline into a condensate collection container.

An advantage of the present invention resides in the fact that by selecting the separating wall in the heat exchanger tube it is possible to adapt the cross-sections of the condenser stretch and the dephlegmator stretch specifically to the volumetric flow of the steam. In other words, the cross-section decreases to the same extent as the steam quantity becomes less due to the condensation. In this manner, as compared to constant cross-sections of the tube, it is possible to achieve a significantly more uniform velocity of the steam, particularly in the condenser stretch.

Since the cross-section of the dephlegmator stretch now becomes smaller from the entry of the steam up to the upper end, swallowing of the condensate is prevented in the lower portion of the dephlegmator stretch which has a greater cross-section. The condensation efficiency is increased.

Another advantage is the fact that transfer lines from the heat exchanger tubes operated as condensers to the heat exchanger tubes operated as dephlegmators are no longer required. The condenser function as well as the dephlegmator function are combined in a single heat exchanger tube or a heat exchanger bundle.

The present invention can be realized equally in heat exchanger tubes with fins arranged at the circumference thereof, as well as in heat exchanger tubes without fins.

Moreover, the cross-sectional shape of the heat exchanger tube is not significant, as long as the cross-section is elongated in the flow direction of the cooling air. In other words, the walls of the tube facing each other may extend parallel to each other or may also be arc-shaped, as is the case in large oval tubes. Finally, it is possible that the heat exchanger tube can be arranged in the cooling air flow in such a way that either the condenser stretch is subjected first to the cooling air and then the dephlegmator stretch, or the dephlegmator stretch is first subjected to the cooling air and then the condenser stretch.

The heat exchanger according to the present invention makes it much easier to combine heat exchanger tubes to form larger condensers, particularly in a roof-shaped and one-sided configuration.

Depending on the local requirements, it is now possible to essentially optimize the condenser/dephlegmator ratio without compromise. For example, it is possible to use a separating wall which extends in a straight line in the flow direction of the steam. Also conceivable is an embodiment in which the separating wall is composed of at least two length portions which are arranged at an angle relative to each other. Also, it is possible to have a separating wall which is convex or concave toward the condenser stretch.

In accordance with a particularly advantageous embodiment, the heat exchanger tube is composed of two shells. The shells have straight and planar surfaces facing each other. When the heat exchanger tube is manufactured, only portions of a longitudinal edge of the separating wall are connected in spots to the inner surface of one of the shells. When the two shells are joined together, the other longitudinal edge of the separating wall is pressed in a resiliently yielding manner against the inner surface of the other shell. For this purpose, the separating wall is provided with a slightly arched shape, so that the separating wall is then clamped between the two shells with initial tension.

This embodiment provides the advantage that condensate can now be transferred from the dephlegmator stretch into the condenser stretch through the gaps existing between the longitudinal edges of the separating wall and the inner surfaces of the shells. This further reduces the danger of swallowing. On the other hand, small amounts of steam can flow through these gaps from the condenser stretch into the dephlegmator stretch and can condense in the dephlegmator stretch.

Within the scope of the present invention, it is further conceivable to dimension the length of the dephlegmator stretch shorter than that of the condenser stretch. This is particularly applicable to very long heat exchanger tubes. In that case, the condensation of the steam in the dephlegmator stretch is usually concluded in a vertical area which is located approximately in the middle of the height of the condenser stretch. Accordingly, it is sufficient if the dephlegmator stretch extends only to this area and to provide the gas/steam mixture exhauster at this end of the dephlegmator stretch.

The versatility of the heat exchanger tube according to the present invention becomes even greater if the length of the dephlegmator stretch is variable. This can be achieved by means of an insert which can be adjusted in the longitudinal direction of the dephlegmator stretch and then secured, for example, a piece of sheet metal. The gas/steam mixture exhauster can then also be connected to this insert.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
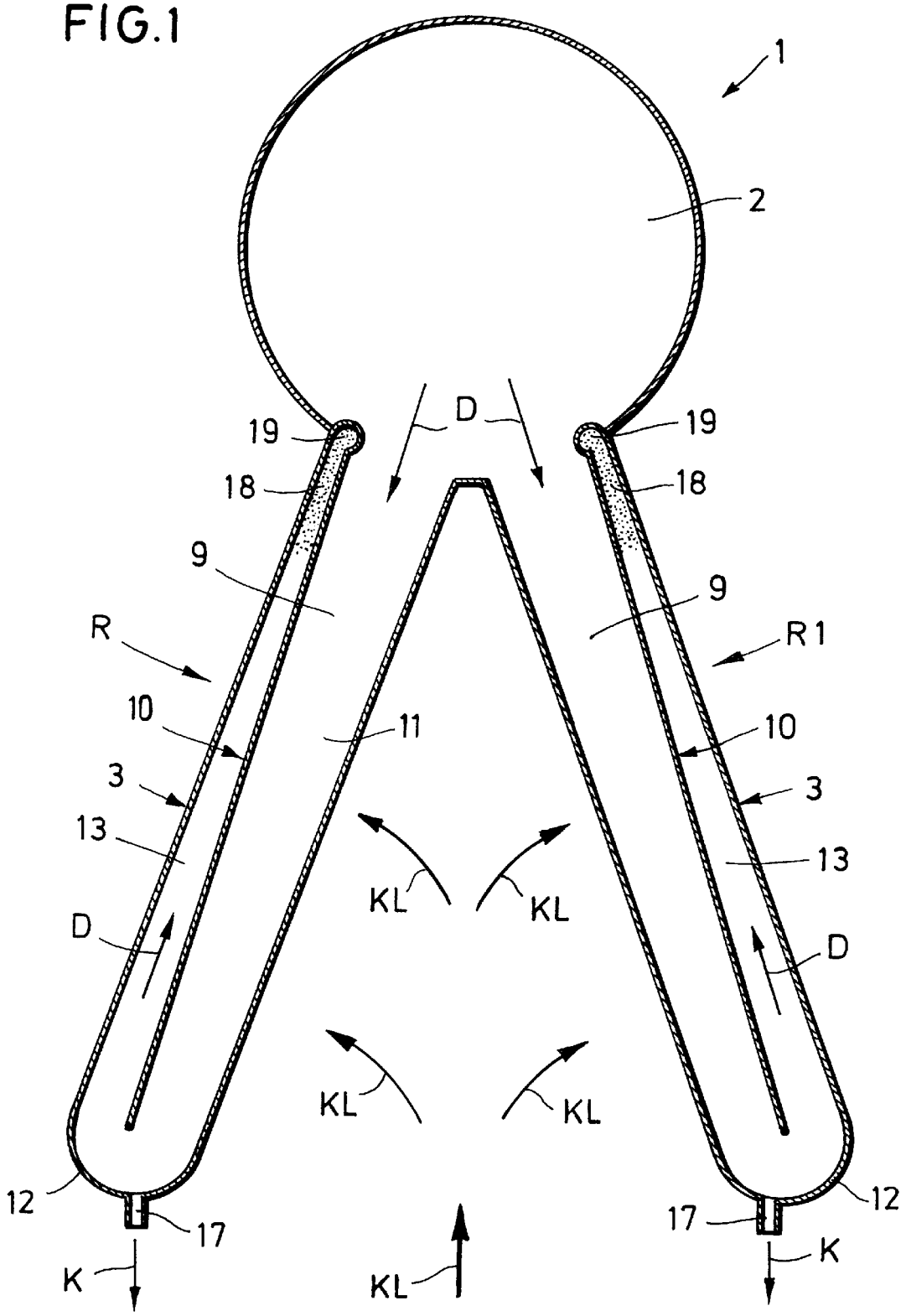
FIG. 1 is a schematic vertical cross-sectional view of an air-cooled roof-shaped condenser.

The condenser 1 schematically illustrated in FIG. 1 is component part of a heat exchanger plant which is arranged at a distance above the ground. The heat exchanger plant is used for the condensation of steam, for example, produced in a power plant.

The condenser 1 has at the top thereof a distribution chamber 2 for the steam D and two rows R, R1 of parallel heat exchanger tubes 3, wherein the rows are arranged in a V-shaped configuration relative to each other.

Figure 2:
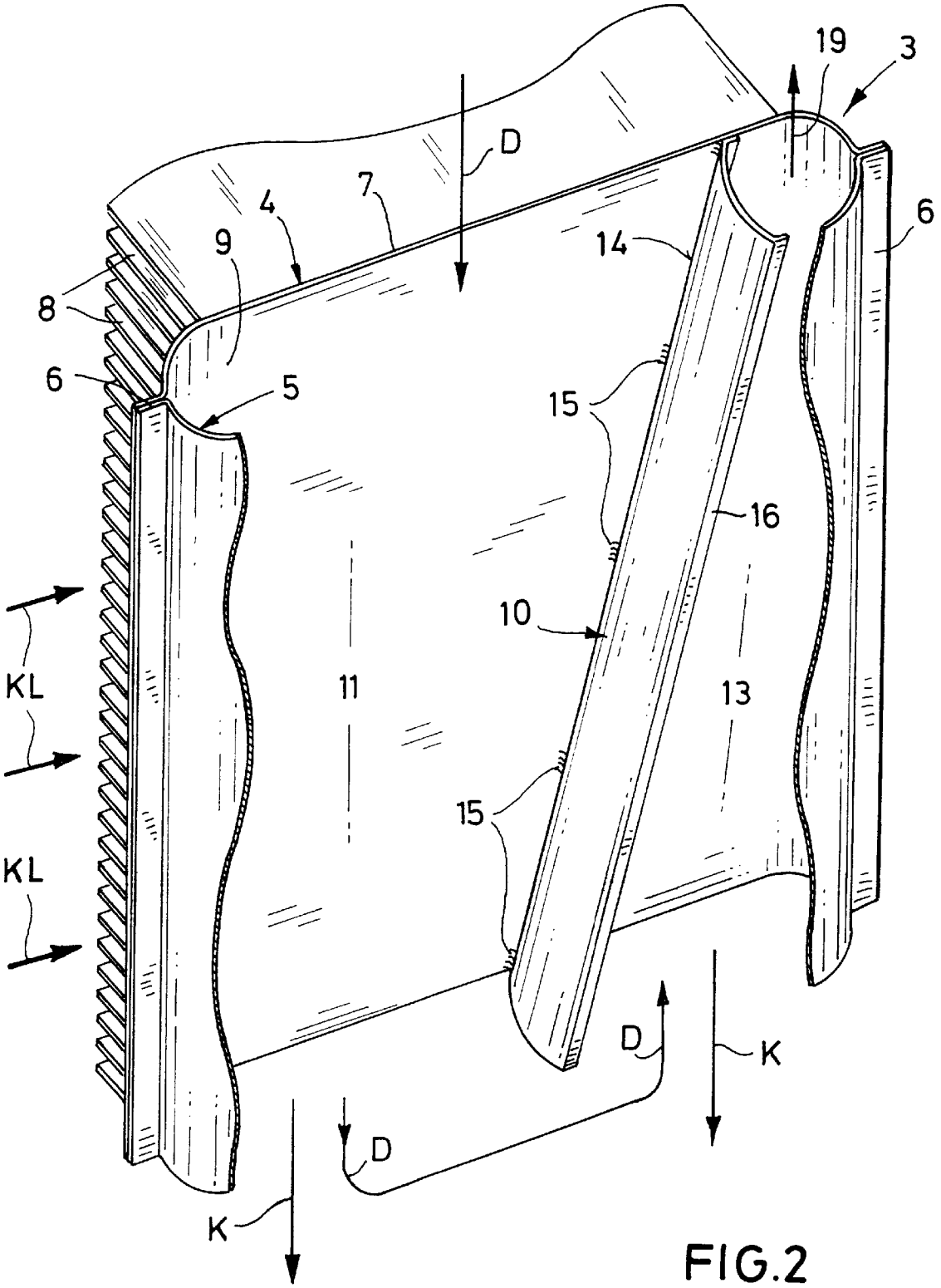
FIG. 2 is a perspective view, partially in section, showing a longitudinal portion of a heat exchanger tube of the condenser of FIG. 1.

One of the heat exchanger tubes 3 is shown in more detail in FIG. 2.

The heat exchanger tube 3 has an elongated cross-section in flow direction of the cooling air KL. The heat exchanger tube 3 is formed of two shells 4, 5 which are connected to each other through longitudinal flanges 6 at the edges thereof. On the outer sides of the walls 7 of the shells 4, 5 extending parallel to each other are provided fins 8 which extend parallel to the flow direction of the cooling air KL.

The cooling air KL is produced by ventilators, not shown in detail.

The heat exchanger tubes 3 of FIGS. 1 and 2 have in the interiors 9 thereof separating walls 10 extending transversely of the flow direction of the cooling air KL. The separating walls 10 separate the interiors 9 into a condenser stretch 11 whose cross-section becomes smaller in the flow direction of the steam D and a dephlegmator stretch 13 whose cross-section becomes smaller in the flow direction of the steam D, wherein the condenser stretch 11 and the dephlegmator stretch 13 are in communication with each other at the lower end 12 of each heat exchanger tube 3.

Figure 3:
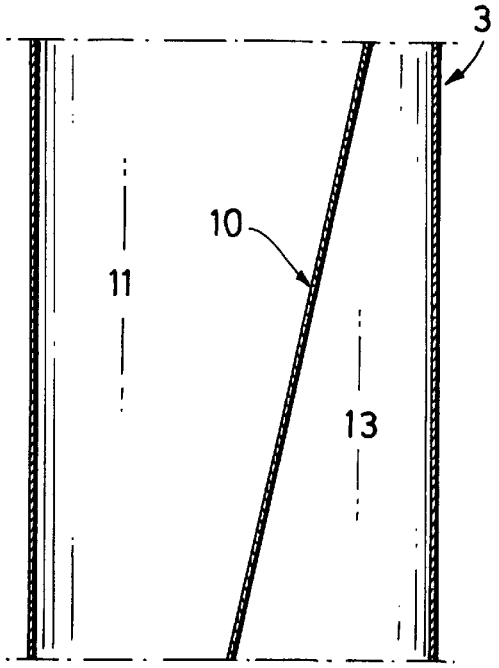
FIGS. 3 to 6 are schematic vertical longitudinal sectional views of the heat exchanger tube of FIG. 2 with differently arranged separating walls.

In the embodiments shown in FIGS. 1, 2 and 3, the separating walls 10 extend in a straight line essentially in the flow direction of the steam D.

For manufacturing the heat exchanger tube 3, a longitudinal edge 14 of the separating wall 10 is connected by spot welding 15 over portions thereof to the wall 7 of the shell 4. The separating wall 10 is provided with a slightly arc-shaped curvature in the direction extending transversely of the flow direction of the cooling KL, so that, when the two shells 4, 5 are connected, the other longitudinal edge 16 of the separating wall 10 comes into contact in a resiliently yielding manner with the wall 7 of the outer shell 5.

As illustrated in FIGS. 1, 2 and 3, the steam D to be condensated enters the condenser stretch 11 at the upper end thereof, flows downwardly and a portion of the steam D is condensed by the cooling air KL. The condensate K leaves the condenser stretch 11 as a result of gravity through a pipeline 17 and is conducted to a condensate collection container, not shown in detail.

The residual steam and any gases which cannot be condensated flow at the lower end of the separating wall out of the condenser stretch 11 into the dephlegmator stretch 13 and upwardly in the dephlagmator stretch 13. In the dephlegmator stretch 13, the steam D is almost completely condensed. A mixture of non-condensable gases and steam collects in the upper portion 18 of the dephlegmator stretch 13, wherein this mixture is undercooled by the cooling air KL relative to the condensation temperature and is suctioned off in this manner by a gas/steam mixture exhauster or evacuator 19. The condensate K produced in the dephlegmator stretch 13 also flows as a result of gravity through the pipeline 17 into the condensate collection container.

Figure 4:
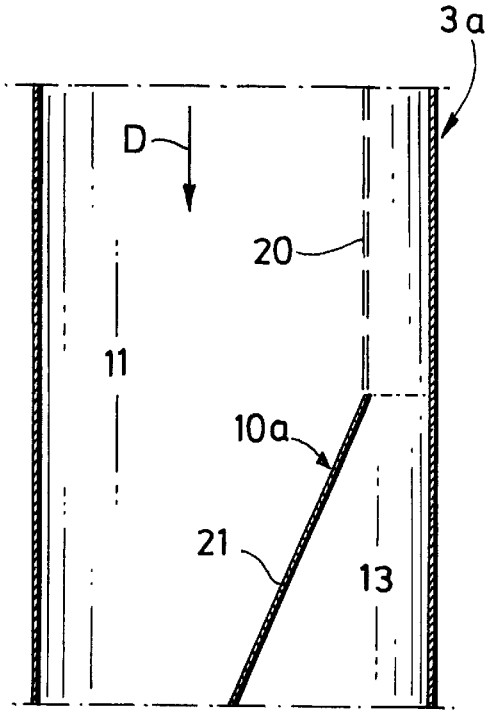

While, as already mentioned, the separating walls 10 of the heat exchanger tubes 3 shown in FIGS. 1, 2 and 3 have a straight configuration, FIG. 4 shows an embodiment of the heat exchanger tube 3*a* in which the separating wall 10*a* has two length portions 20, 21, which are arranged at an angle relative to each other. The upper length portion 20 extends parallel to the flow direction of the steam D, while the other length portion 21 below length portion 20 is arranged in such a way that the cross-section of the condenser stretch 11 becomes smaller in the flow direction of the steam D.

By showing the upper vertical length portion 20 in broken lines in FIG. 4, it is indicated that the length portion 20 can also be omitted. However, in that case, the dephlegmator stretch 13 then ends approximately in the middle vertical portion of the condenser stretch 11.

Figure 5:
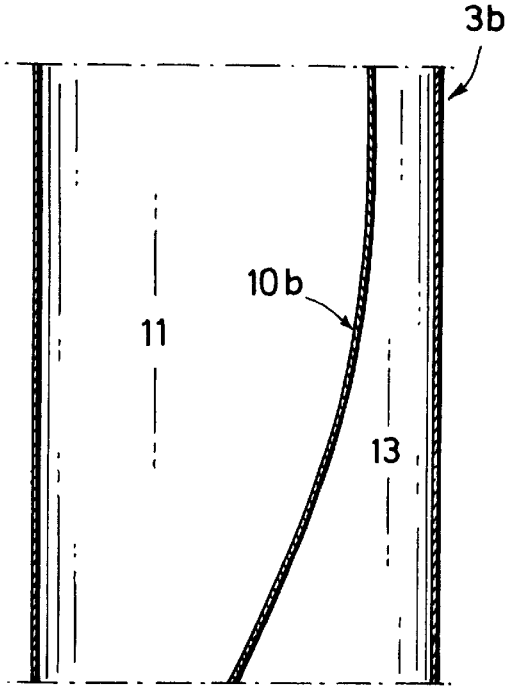
Figure 6:
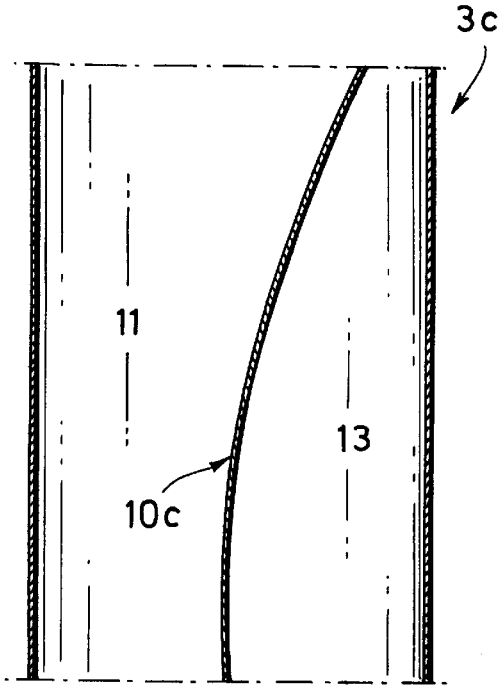

FIG. 5 shows a heat exchanger tube 3*b* with a separating wall 10*b* which has a concave curvature toward the condenser stretch 11, while FIG. 6 shows a heat exchanger tube 3*c* in which the separating wall 10*c* has a convex curvature toward the condenser stretch 11.

While specific embodiments of the invention have been shown and described in detail to illustrate the inventive principles, it will be understood that the invention may be embodied otherwise without departing from such principles.

I claim:

1. A heat exchanger tube for condensing steam with the use of cooling air, the heat exchanger tube having a steam supply at a top thereof and a condensate discharge means at a bottom thereof, the heat exchanger tube having an elongated cross-section in a flow direction transverse to the flowing cooling air, the heat exchanger tube having an interior, further comprising a separating wall mounted transversely of the flow direction of the cooling air in the interior for dividing the interior into a condenser stretch whose cross-section becomes smaller in a flow direction of the steam and a dephlegmator stretch whose cross-section becomes smaller in the flow direction of the steam toward an upper end, wherein the condenser stretch and the dephlegmator stretch are in communication with each other at the bottom of the tube for conducting steam from the condenser stretch to the dephlegmator stretch, further comprising a gas/steam mixture exhausting means mounted at the upper end of the dephlegmator stretch.

2. The heat exchanger tube according to claim 1, wherein the separating wall extends in a straight line in the flow direction of the steam.

3. The heat exchanger tube according to claim 1, wherein the separating wall is comprised of at least two length portions in the flow direction of the steam, wherein the length portions extend at an angle relative to each other.

4. The heat exchanger tube according to claim 1, wherein the separating wall has in the flow direction of the steam a concave curvature toward the condenser stretch.

5. The heat exchanger tube according to claim 1, wherein the separating wall has in the flow direction of the steam a convex curvature toward the condenser stretch.

6. The heat exchanger tube according to claim 1, wherein the heat exchanger tube is comprised of two shells, wherein a longitudinal edge of the separating wall is over portions thereof attached to a wall of one of the shells and another longitudinal edge of the separating wall is pressed in a resiliently yielding manner against a wall of another of the shells.

7. The heat exchanger tube according to claim 1, wherein the dephlegmator stretch has a variable length.

* * * * *